US008297774B2

(12) United States Patent
Lilenfeld

(10) Patent No.: US 8,297,774 B2
(45) Date of Patent: Oct. 30, 2012

(54) BOOKLIGHT WITH ADJUSTABLE LIGHT-RADIATING SOURCES

(76) Inventor: David Michael Lilenfeld, Atlanta, GA (US)

( * ) Notice: Subject to any disclaimer, the term of this patent is extended or adjusted under 35 U.S.C. 154(b) by 0 days.

(21) Appl. No.: 11/580,083

(22) Filed: Oct. 13, 2006

(65) Prior Publication Data

US 2007/0097666 A1 May 3, 2007

Related U.S. Application Data

(60) Provisional application No. 60/731,409, filed on Oct. 31, 2005.

(51) Int. Cl.
*F21S 8/08* (2006.01)

(52) U.S. Cl. ..... 362/98; 362/99; 362/436; 362/235; 362/238

(58) Field of Classification Search ..... 362/98, 362/99, 436, 438
See application file for complete search history.

(56) References Cited

U.S. PATENT DOCUMENTS

| | | | | | |
|---|---|---|---|---|---|
| 664,664 | A | * | 12/1900 | Motgomery | 248/452 |
| 919,811 | A | * | 4/1909 | Beynon | 200/465 |
| 1,010,335 | A | * | 11/1911 | Williams | 362/270 |
| 1,017,460 | A | * | 2/1912 | Polverino | 248/458 |
| 2,555,000 | A | * | 5/1951 | Nitardy | 362/220 |
| 2,561,744 | A | * | 7/1951 | Langdon et al. | 362/99 |
| 2,597,662 | A | * | 5/1952 | Melamed et al. | 362/99 |
| 2,648,762 | A | * | 8/1953 | Dunkelberger | 362/198 |
| 3,381,122 | A | * | 4/1968 | Boyle, Jr. | 362/99 |
| 4,454,567 | A | * | 6/1984 | Ross et al. | 361/506 |
| 4,528,618 | A | * | 7/1985 | Bitsch | 362/33 |
| 4,680,681 | A | * | 7/1987 | Fisherman et al. | 362/98 |
| D306,351 | S | * | 2/1990 | Charet et al. | D26/43 |
| 4,999,756 | A | * | 3/1991 | Lee | 362/249.1 |
| 5,154,483 | A | * | 10/1992 | Zeller | 362/198 |
| 5,180,220 | A | * | 1/1993 | Van Kalsbeek | 362/98 |
| 5,280,416 | A | * | 1/1994 | Hartley et al. | 362/98 |
| D357,993 | S | * | 5/1995 | Yuen | D26/65 |
| 5,442,528 | A | * | 8/1995 | Vandenbelt | 362/98 |
| 5,689,232 | A | * | 11/1997 | O'Shaughnessy et al. | 340/468 |
| D387,457 | S | * | 12/1997 | Bennett | D26/62 |
| 5,695,271 | A | * | 12/1997 | Zeller | 362/98 |
| 6,361,184 | B1 | * | 3/2002 | Hallgrimsson et al. | 362/188 |
| 6,419,370 | B1 | * | 7/2002 | Chen | 362/98 |
| 6,666,563 | B2 | * | 12/2003 | Brown | 362/84 |
| 6,736,531 | B2 | * | 5/2004 | Wallach | 362/414 |
| D498,322 | S | * | 11/2004 | Schnell | D26/60 |
| 7,168,824 | B2 | * | 1/2007 | Schnell | 362/256 |
| 7,175,295 | B2 | * | 2/2007 | Bretz et al. | 362/108 |
| 7,267,460 | B2 | * | 9/2007 | Lefferson | 362/371 |
| 7,390,105 | B2 | * | 6/2008 | Nelson et al. | 362/198 |
| 7,490,948 | B2 | * | 2/2009 | Fisherman et al. | 362/98 |
| 7,547,126 | B2 | * | 6/2009 | Hiratsuka | 362/413 |

* cited by examiner

*Primary Examiner* — Anabel Ton

(57) ABSTRACT

The present invention relates to a booklight which is free-standing or attaches to a book cover, a bed frame or other supporting object to facilitate the reading of a book. Attached to each arm is at least one light-radiating source which may be housed within a shade. The light-radiating source may be an incandescent, fluorescent or LED bulb, or the like, as is known in the art. The angle and direction of each light-radiating source can be manually and separately adjusted by the user to focus light on different areas of the book simultaneously.

4 Claims, 5 Drawing Sheets

BOOKLIGHT WITH ADJUSTABLE LIGHT-RADIATING SOURCES

REFERENCE TO PROVISIONAL APPLICATION

Applicant relies on the filing date of his Provisional Patent Application No. 60/731,409, filed Oct. 31, 2005.

CROSS-REFERENCE TO RELATED APPLICATIONS

Not applicable.

FEDERALLY SPONSORED RESEARCH OR DEVELOPMENT

Not applicable.

REFERENCE TO SEQUENCE LISTING

Not applicable.

BACKGROUND OF THE INVENTION

1. Field of the Invention

The present invention relates to a booklight which is free-standing or attaches to a book cover, a bed frame or other supporting object to facilitate the reading of a book.

2. Discussion of Related Art

Booklights have been known for many years and are intended to assist a user while reading in bed, traveling or in other places where there is insufficient reading light.

Booklights known in the art consist of a single shade containing a light-radiating source. Booklights also consist of a power supply, which may include batteries, AC/DC connector and the like.

A major drawback of booklights known in the art is the lack of sufficient illumination of the book. As shown in FIG. 1, with booklights known in the art, there are areas of the book then being read which are without sufficient illumination 5. For the reader to have sufficient lighting on the page of the book being read, the user must manually adjust the shade to direct the light onto that page. This requires a tiring and wasteful process of the user having to adjust the shade to the left when reading the left page of the book and then adjusting the shade to the right when reading the right page of the book and repeating this process during the entire time he or she is reading. This process slows the pace of reading, distracts the reader and detracts from the enjoyment of reading. Also, a user may grow tired of trying to read without adequate illumination and may stop reading. Also, a user may also choose to stop adjusting the shade but continue to read with poor lighting which may adversely impact the user's vision, especially over a period of years.

BRIEF SUMMARY OF THE INVENTION

The booklight disclosed herein consists of a base which can employ a variety of means to allow the invention to rest on a surface or to be attached to a book or other supporting object. The base also contains or can be connected with a power supply as is known in the art.

In the preferred embodiment, the current invention consists of two or more arms which are attached to the base. Attached to each arm is at least one light-radiating source which may be housed within a shade. The light-radiating source may be an incandescent, fluorescent or LED bulb, or the like, as is known in the art.

With the current invention, the angle and direction of each light-radiating source can be manually and separately adjusted by the user to focus light on different areas of the book simultaneously. It is expected, though not required, that a user of the current invention would direct one light-radiating source onto the left page of the book and direct the second light-radiating source onto the right page of the book. Thus the current invention eliminates the tiresome process of continually making adjustments to the booklight.

In an alternative embodiment, the invention has a base and a vertical arm attached perpendicularly to the base. The vertical arm is also attached perpendicularly to a second arm. At least two light-radiating sources are attached to the second arm and may independently be adjusted to direct light onto different areas of the book being read.

An object of the present invention is to overcome the problems associated with booklights known in the art, as described above. In particular, an object of the present invention is to provide multiple light-radiating sources which can be used to direct light onto more than one area of the book simultaneously. Thus, the current invention better illuminates the book being read.

BRIEF DESCRIPTION OF DRAWINGS

A better understanding of the objects, features and advantages of the invention can be gained from a consideration of the following detailed description of the embodiments thereof, in conjunction with the appended figures of the drawings, wherein a given reference character always refers to the same or like element or part and wherein.

The drawings are for the purpose of illustration only and are not included as any limitation of the scope of the disclosed system. Similar reference characters denote corresponding features consistently throughout the attached drawings.

The drawings are informal. Formal drawings will be submitted when requested by the Examiner.

DETAILED DESCRIPTION OF THE INVENTION

Figure 1:
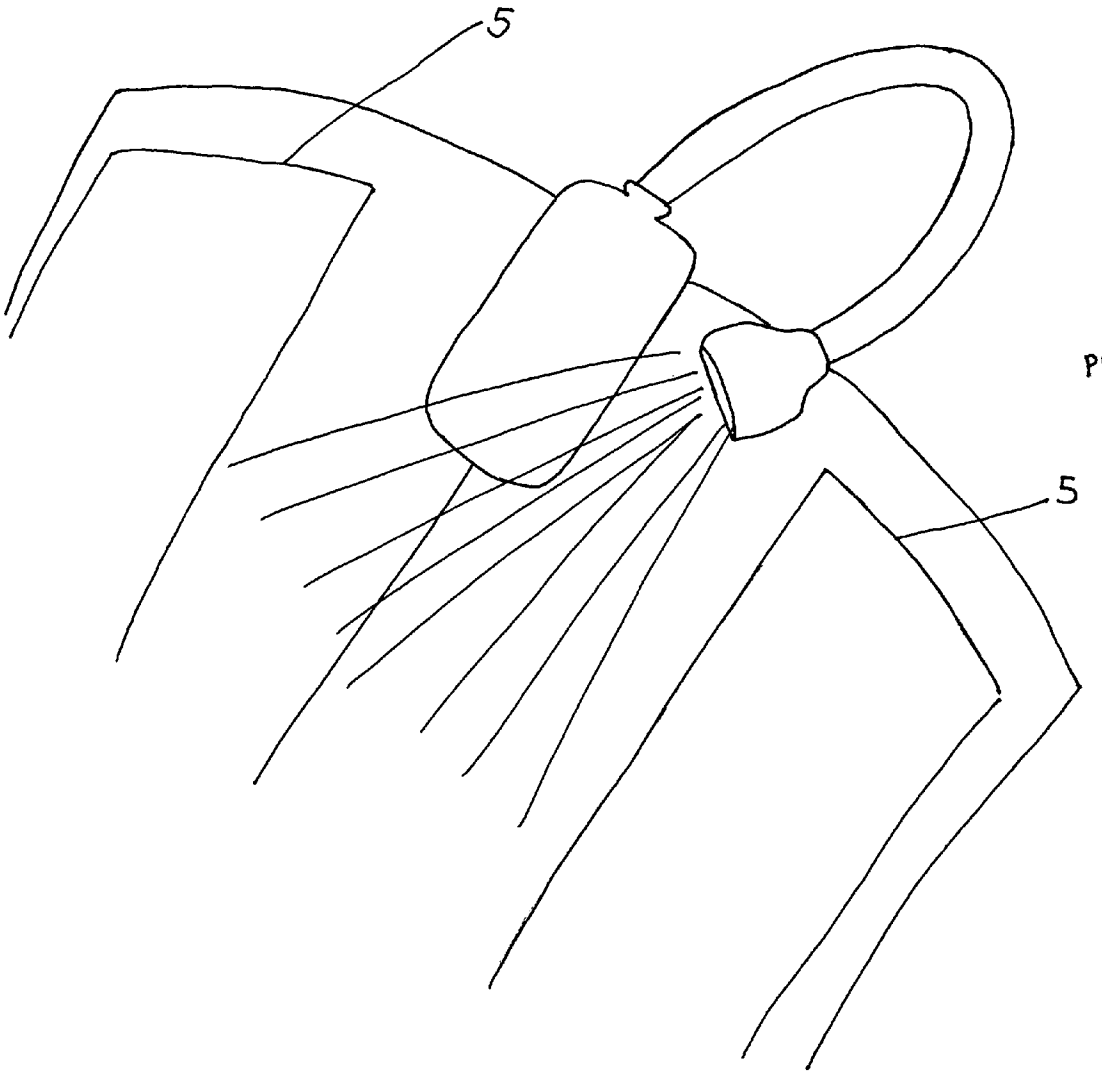
FIG. 1 PRIOR ART
FIG. 1 is a drawing of prior art showing a limitation of booklights known in the art.
Figure 2:
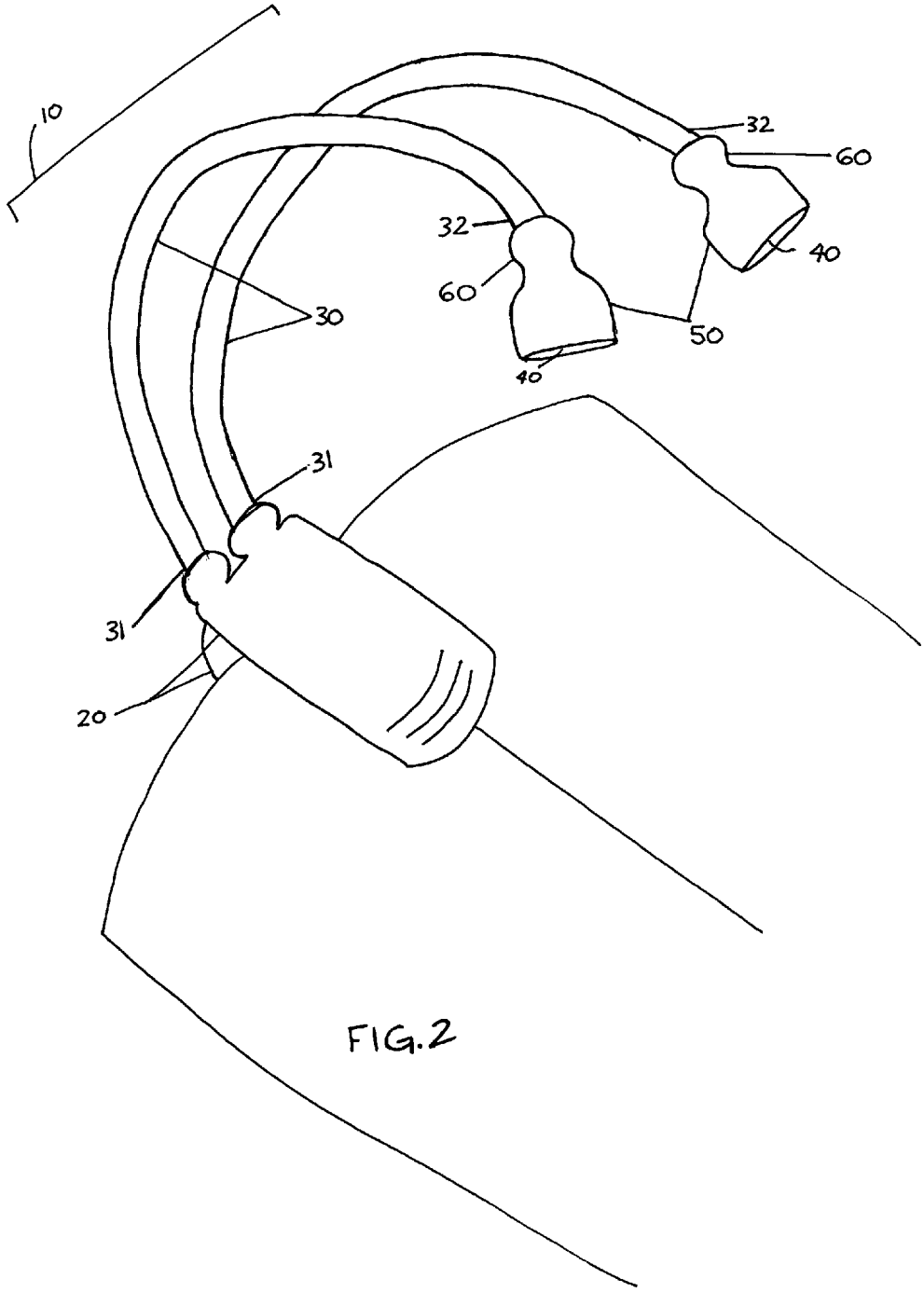
FIG. 2 is a perspective view of a booklight with two lamps which is the preferred embodiment of the invention disclosed herein.

Referring to FIG. 2, the present invention 10 consists of a base 20 which is used for the booklight to be free-standing or to attach to a book, a bed frame or other supporting object. Various methods and means known in the art, such as a clamp, can be used to achieve this purpose.

In the preferred embodiment, the present invention 10 further consists of two or more arms 30 with each arm having a proximal end 31 and a distal end 32. The proximal end 31 of each arm 30 is adjustably attached to the base 20 through an assembly known in the art. Such adjustable assemblies 60 may include, but are not limited to, "goose necks," hinges, joints, pivots, ball joints, rollers or other adjustable or movable assemblies as are known in the art.

One or more light-radiating sources 40 are attached to each arm 30. Shades 50 may be used to house the light-radiating sources 40 to focus light and trap heat emanating from the light-radiating source 40. The light-radiating source 40 is attached to the arm 30 using an adjustable assembly 60 as is known in the art. The adjustable assembly 60 allows the user to adjust the angle and direction of each light-radiating source 40. If a shade 50 is employed in a particular embodiment it would be attached to the arm 30 through an adjustable assembly 60 and would be adjustable by the user to direct the light-radiating source 40 on one area o the book or another.

To provide the most optimum illumination of the book being read by the user, the angle and direction of each light-radiating source 40 or shade 50 can be manually adjusted by the user. For example, the user may desire to adjust one light-radiating source 40 or shade 50 toward the left page of a book and the second light-radiating source 40 or shade 50 toward the right page of a book. Doing so illuminates both pages of the book simultaneously.

Figure 3:
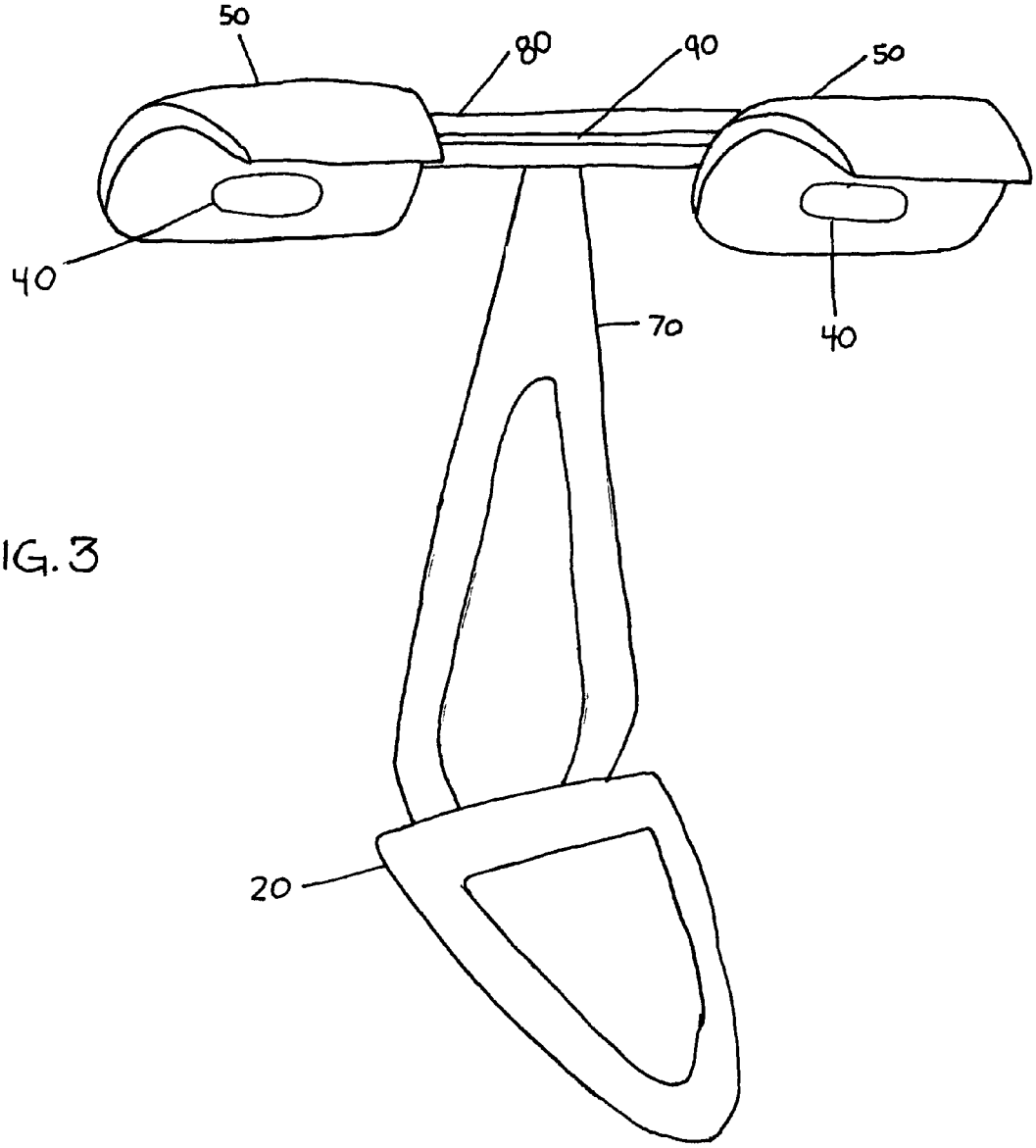
FIG. 3 is a perspective view of a booklight with a both horizontal and vertical arms and arms sliding shades which is an alternative embodiment of the invention disclosed herein.

FIG. 3 shows an alternative embodiment of the invention 10 having a base 20 and a vertical arm 70 attached thereto though an adjustable assembly known in the art. The second end of the vertical arm 70 is attached to a horizontal arm 80. At least two shades 50 are attached to the horizontal arm 80 and each shade 50 contains at least one light-radiating source 40. Said shades 50 may be fixed to the horizontal arm 80 or, alternatively, attached to the horizontal arm 80 through a sliding mechanism 90 as is known in the art.

Figure 4:
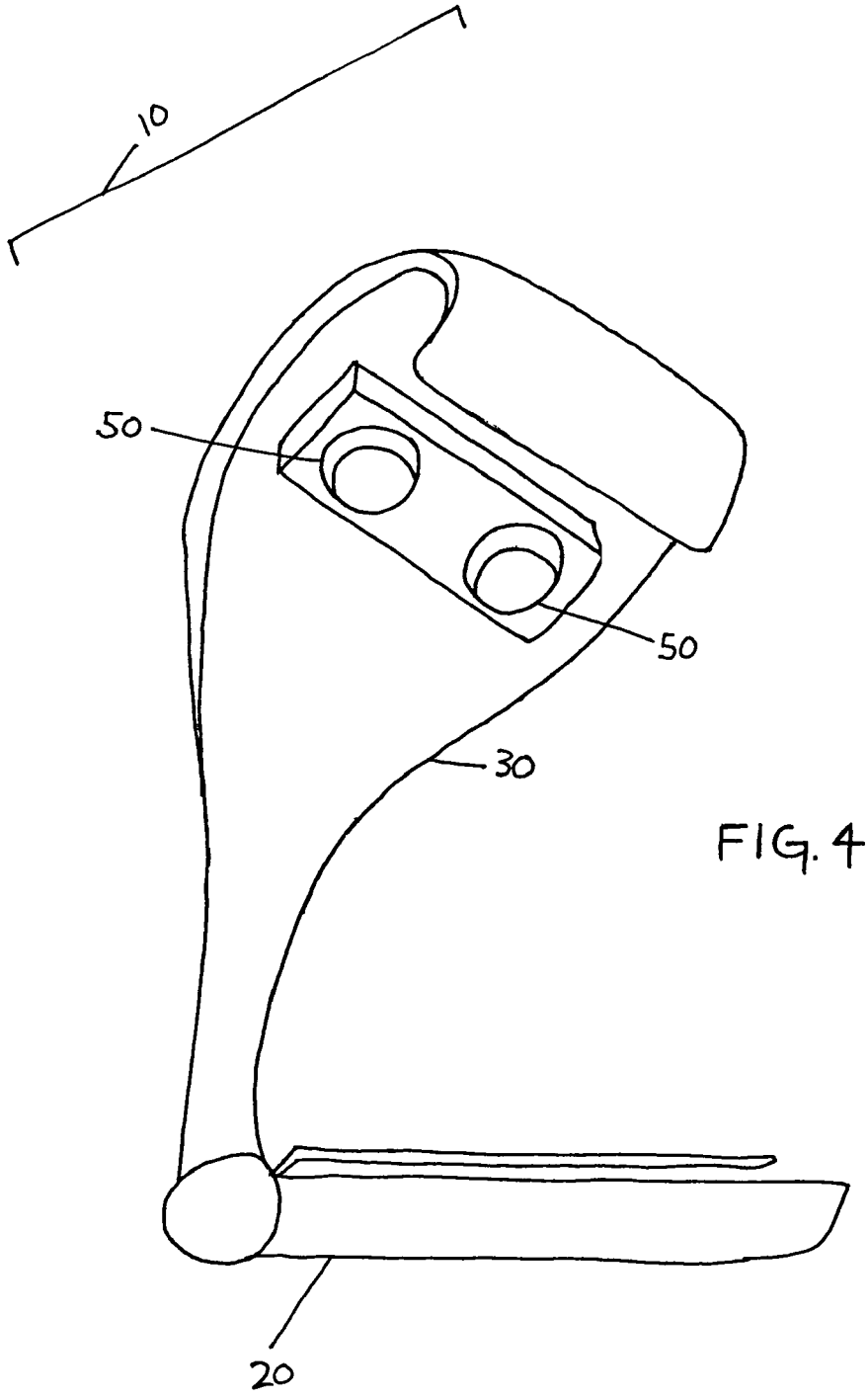
FIG. 4 is a perspective view of an alternative embodiment of a booklight with two light-radiating sources which are independently adjustable.
Figure 5:
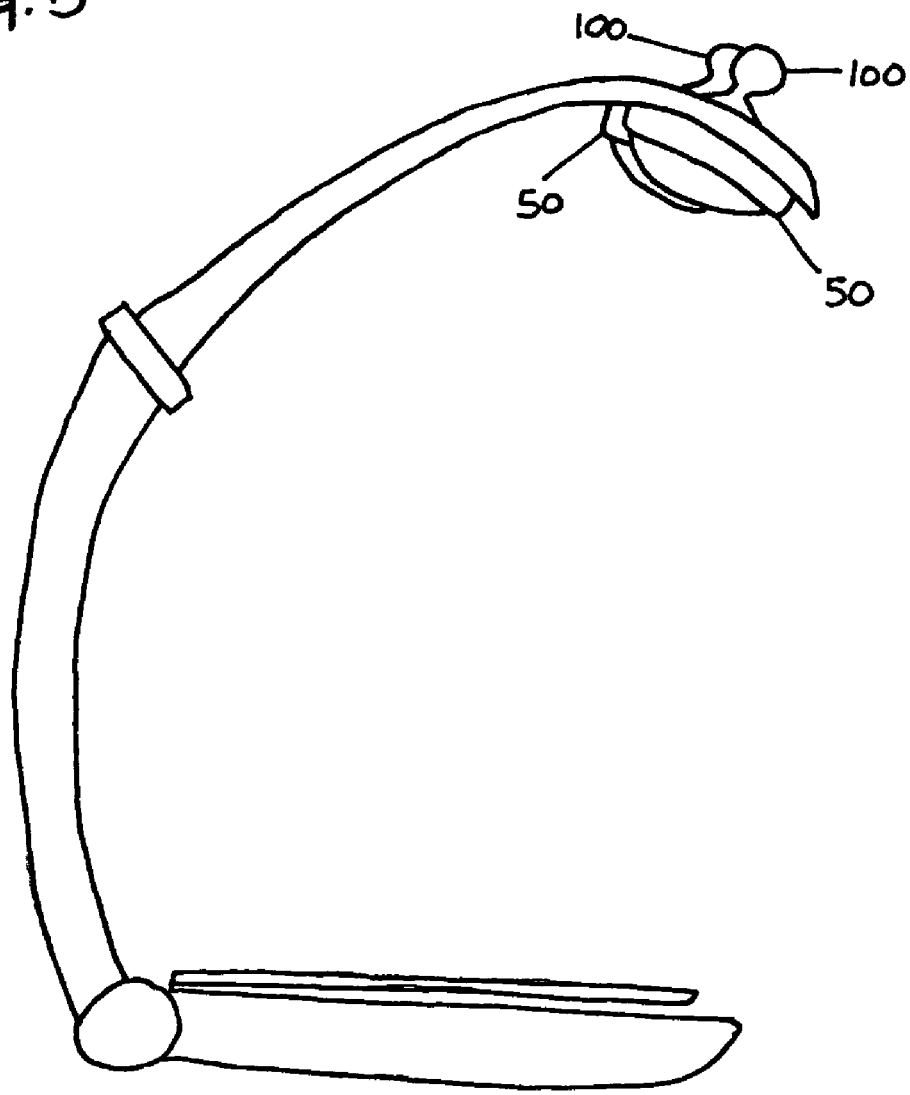
FIG. 5 is a top perspective view of an alternative embodiment of a booklight with two light-radiating sources which are independently adjustable.

FIG. 4 shows an alternative embodiment in which the invention 10 consists of a base 20 and one arm 30. Two or more shades 50 are pivotally attached to the arm 30. The angle and direction of each shade 50 may be manually and separately adjusted by the user to direct light as desired by the user. FIG. 5 shows a means for adjusting said shades which includes at least one knob 100 above the arm 30 which traverses the arm 30 and connects to and controls a shade 50.

It should now be understood that what has been disclosed herein comprises a novel booklight 10. Those having skill in the art, to which the booklight 10 pertains, will now, as a result of the applicant's teachings herein, perceive various modifications and additions which may be made to the booklight 10. For example, the features described herein may be altered or omitted in varying ways while still achieving the listed benefits. The booklight 10 may be made of various materials and in various colors. It is intended that all such additional features and advantages be included herein within the scope of the present invention.

Accordingly, the scope of the disclosure should be determined not by the embodiment illustrated, but by the appended claims and their legal equivalents. All such modifications and additions are deemed to be within the scope of the invention which is to be limited only by the claims appended herein. It is to be understood that the drawings are for the purpose of illustration only and are not included as any limitation of the scope of the invention.

What I claim as my invention is:

1. A booklight comprising:

a base;

a vertical arm having a proximal end and a distal end, said proximal end attached to said base;

a horizontal arm having a first end and a second end, said horizontal arm attached to said distal end of the said first arm at a midpoint of said horizontal arm;

a first light source attached to said first end of said horizontal arm, said first light source independently adjustable to illuminate a first area; and a second light source attached to said second end of said horizontal arm, said second light source independently adjustable to simultaneously illuminate a second area;

wherein said base further comprises a clip for attaching said booklight to a book.

2. The booklight of claim 1, wherein said first area comprises a first page of said book and said second area comprises a second page of said book.

3. The booklight of claim 1, wherein said horizontal arm further comprises shades attached to said first end and said second end.

4. The booklight of claim 3, wherein said shades are adjustable.

* * * * *